US005553522A

United States Patent [19]

Boldrini et al.

[11] Patent Number: 5,553,522

[45] Date of Patent: Sep. 10, 1996

[54] METHOD AND DEVICE FOR CHANGING STRIP MATERIAL ON A PRODUCTION MACHINE

[75] Inventors: Fulvio Boldrini, Ferrara; Lorenzo Cocchi; Antonio Gamberini, both of Bologna, all of Italy

[73] Assignee: G.D. Societa' per Azioni, Bologna, Italy

[21] Appl. No.: 270,922

[22] Filed: Jul. 5, 1994

[30] Foreign Application Priority Data

Jul. 5, 1993 [IT] Italy ..... B093A0313

[51] Int. Cl.[6] ..... B65B 41/10; B65H 20/02; B65H 19/20

[52] U.S. Cl. ..... 83/13; 226/42; 242/562.1; 242/564.4; 83/650; 83/949

[58] Field of Search ..... 242/562.1, 563, 242/564.4, 554.4, 554.2, 555.2; 226/2, 30, 31, 42; 83/13, 23, 105, 106, 156, 370, 649, 650, 949

[56] References Cited

U.S. PATENT DOCUMENTS

| | | | |
|---|---|---|---|
| 3,925,131 | 12/1975 | Krause | 242/554.6 X |
| 4,159,807 | 7/1979 | Honsel et al. | 242/562.1 |
| 4,188,257 | 2/1980 | Kirkpatrick | 242/554.6 X |
| 4,694,714 | 9/1987 | Focke et al. | 242/554.4 X |
| 5,107,701 | 4/1992 | Boldrini | 83/13 |
| 5,129,294 | 7/1992 | Boldrini et al. | 242/564.4 X |

FOREIGN PATENT DOCUMENTS

| | | |
|---|---|---|
| 0176789 | 4/1986 | European Pat. Off. . |
| 2387627 | 11/1978 | France . |

*Primary Examiner*—John M. Jillions
*Attorney, Agent, or Firm*—Ladas & Parry

[57] ABSTRACT

A method and device whereby a first runout strip, fed at a first speed along a guide by a traction device, is replaced with a new strip by cutting the first strip; activating both a push device, by which the new strip is engaged and fed along the guide at a second speed, and a movable guide device a portion of the guide and which is lowered in relation to the rest of the guide and together with a trailing portion of the first strip on the movable guide device itself; and controlling the second speed as a function of the first speed so that a leading portion of the new strip is superimposed on the trailing portion of the first strip along the movable guide device.

15 Claims, 6 Drawing Sheets

METHOD AND DEVICE FOR CHANGING STRIP MATERIAL ON A PRODUCTION MACHINE

BACKGROUND OF THE INVENTION

The present invention relates to a method of changing strip material on a production machine.

The present invention may be applied to advantage to packing machines in general, and to cigarette packing machines in particular, to which the following description refers purely by way of example.

For special purposes, such as the formation of collars or internal reinforcing elements of hinged-lid packets, cigarette packing machines employ relatively rigid strip material normally fed off a reel.

When a reel of said strip material runs out, the machine is normally stopped, and the runout reel is replaced with a new reel, the leading end of the strip of which is connected manually by the operator to the trailing end of the runout strip.

Such a system obviously involves considerable downtime and constant supervision by an operator of each packing machine.

To overcome the above drawback, a method, described and illustrated in Italian Patent Application n. 3426A/90, has been proposed enabling the runout reel to be replaced automatically with a new reel.

Though highly effective, implementation of the above known method requires a relatively large-size automatic device in turn requiring relatively accurate adjustment for it to operate correctly.

SUMMARY OF THE INVENTION

It is an object of the present invention to provide a method of replacing a runout strip with a new strip, with no manual assistance required and, above all, without stopping the packing machine.

In particular, it is an object of the present invention to perfect the above known method to eliminate the aforementioned drawbacks.

According to the present invention, there is provided a method of changing strip material comprising two strips, a first of said strips being connected to traction means by which it is drawn and fed at a first given speed along a given path; the method comprising stages consisting in cutting the first strip; and, upon passage of the trailing portion of the first strip through a given point along said path, in pushing the second of said strips along said path at a second given speed; characterized in that it also comprises stages consisting in shifting said trailing portion of the first strip in relation to a portion of said path; controlling the second speed as a function of the first speed, so that the leading portion of the second strip reaches, and is superimposed on, the trailing portion of the first strip at said portion of said path; and restoring said trailing portion, superimposed with said leading portion, to said path.

The above method preferably comprises a further stage consisting in controlling the second speed, subsequent to superimposing said trailing and leading portions, so that, when engaged by said traction means, said leading and trailing portions remain in said superimposed position.

According to a preferred embodiment of the above method, said path is defined by guide means comprising a movable guide device defining a portion of the guide means located at said portion of the path; said trailing portion being moved to and from said path by respectively raising and lowering said movable guide device in relation to the path simultaneously with the passage of said trailing portion on the movable guide device.

In the above embodiment, the method preferably comprises a further stage consisting in securing said trailing portion to the movable guide device in transversely-fixed, axially-movable manner when lowering and raising the movable guide device.

The present invention also relates to a device for changing strip material on a production machine.

According to the present invention, there is provided a device for changing strip material comprising two strips; the device comprising traction means for drawing a first of said strips along a given path and at a first given speed; guide means defining said path; cutting means for cutting the first strip; sensor means for detecting passage of the trailing portion of the first strip through a given point along said path; and push means, activated by said sensor means, for feeding the second of said strips along said path at a second given speed; characterized in that a portion of said guide means is a movable portion forming part of a movable guide device movable to and from a guide position aligned with said path and downstream from said given point in the traveling direction of said strips; said second speed being variable to permit a leading portion of the second strip to be superimposed on the trailing portion of the first strip along the movable guide device.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
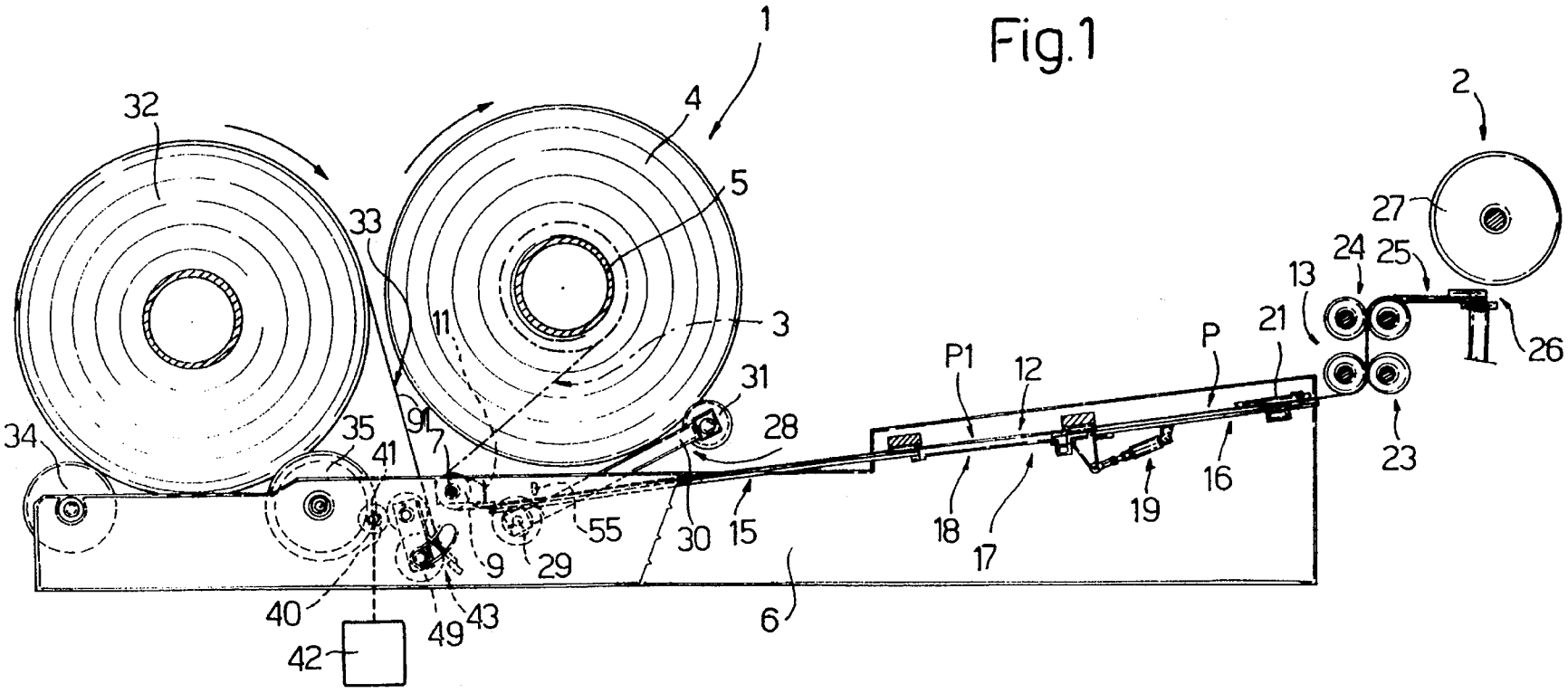
FIG. 1 shows a schematic side view of a preferred embodiment of the strip feed device according to the present invention.

Number 1 in FIG. 1 indicates a device for feeding strip material to a cigarette packing machine 2. In the example shown, the strip material comprises a strip 3 of cardboard or similar fed off a reel 4 with a central core 5 supported for rotation (clockwise in FIG. 1) on a base 6 in a manner not shown.

Figure 2:
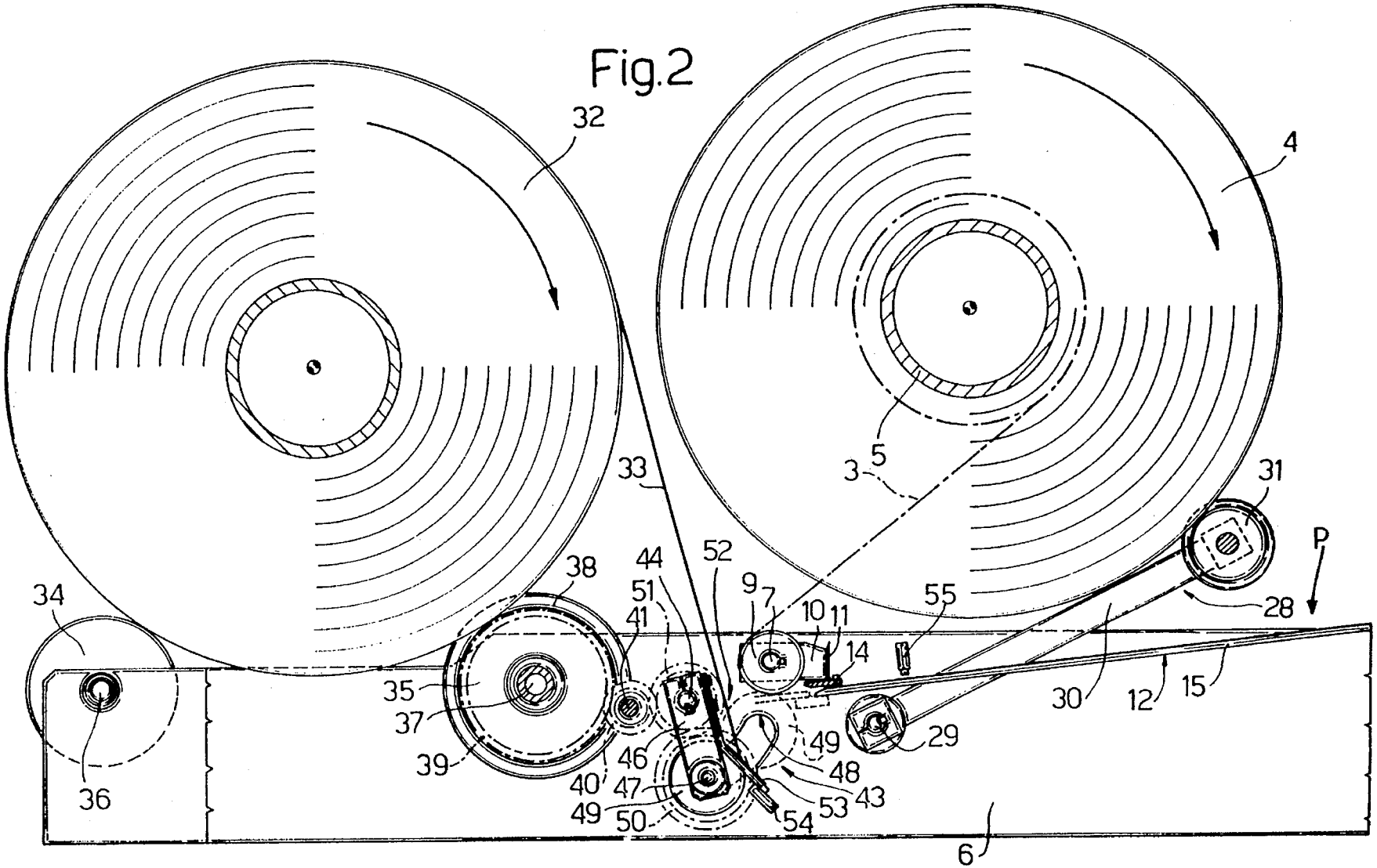
FIG. 2 shows a larger-scale view of a first detail in FIG. 1.

As shown more clearly in FIG. 2, beneath reel 4, base 6 is fitted through with a shaft 7 rotated about its axis by actuating means not shown. Shaft 7 supports an idle roller 9, and is fitted with a transverse rod 10 in turn fitted at one end with a transverse blade 11. Roller 9 is a guide roller about which strip 3 is fed before engaging a guide 12 defining part of the path P of strip 3. Guide 12 extends along base 6, transversely in relation to the axis-of shaft 7, between roller 9 and a traction unit 13 (FIG. 1) constituting the output of device 1 and, at the same time, the input of packing machine 2.

Figure 3:
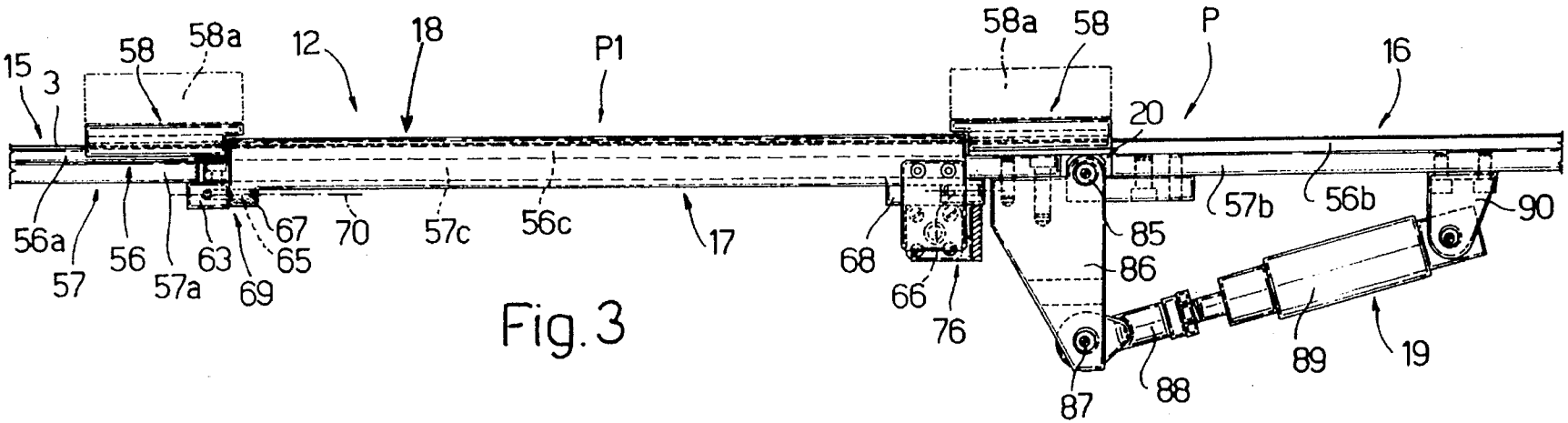
FIGS. 3 and 4 show a larger-scale view of a second detail in FIG. 1 in two different operating positions.
Figure 4:
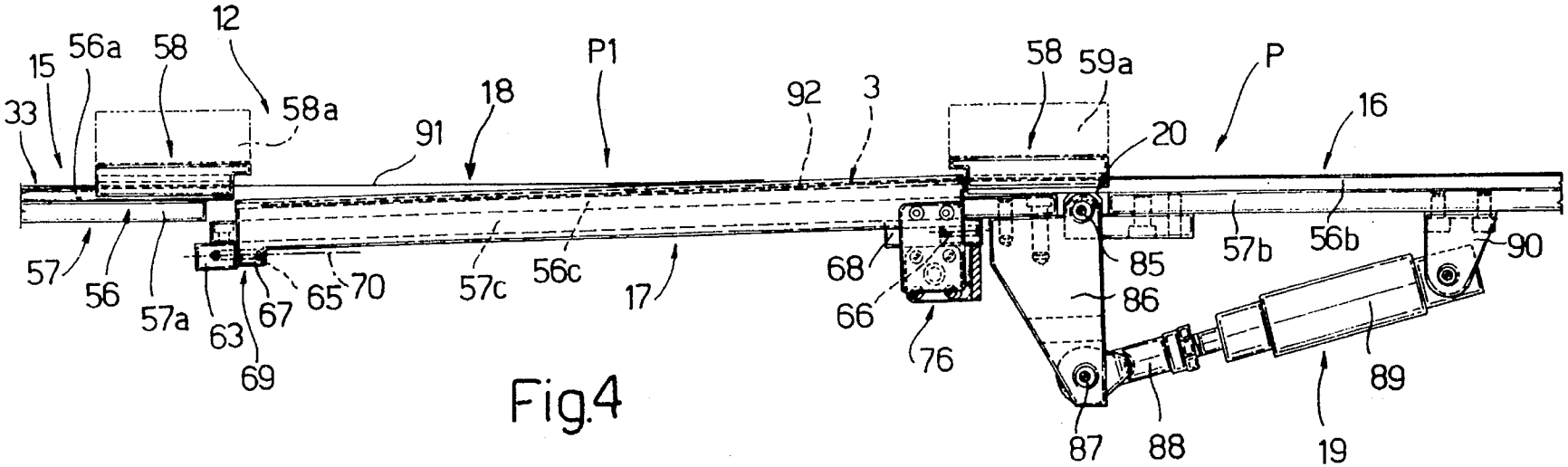

As shown in FIG. 2, the initial portion of guide 12 adjacent to the periphery of roller 9 is closed at the top by a transverse blade 14; and, as shown in FIG. 1, guide 12 comprises a first straight portion 15 sloping slightly upwards as of roller 9, and a second portion 16 (FIGS. 3 to 5) aligned axially with portion 15 and connected to portion 15 by a movable guide device 17 at an intermediate portion P1 of path P. Device 17 comprises a straight guide portion 18 movable, by an actuating device 19 and about the axis of a hinge 20 connecting portion 18 to portion 16, between a guide position (FIG. 3) wherein portion 18 is aligned axially with portions 15 and 16 and along portion P1, and an inclined position (FIG. 4) wherein portion 18 is positioned beneath portion P1. More specifically, when portion 18 is set to the inclined position, the input end of portion 18 is positioned below the output end of portion 15, and the output end of portion 18 slopes downwards in relation to the input end of portion 16.

The end portion of portion 16 is closed at the top by a transverse blade 21 (FIG. 1), and terminates just below traction unit 13 which comprises a first and second pair of rollers, indicated respectively 23 and 24, powered by a motor (not shown and preferably mounted on machine 2) for feeding strip 3 along the input guide 25 of a known cutting unit 26 by which strip 3 is cut transversely into collars (not shown) picked up successively by a suction wheel 27 at the input of machine 2.

As shown more clearly in FIG. 2, beneath reel 4, a detecting device 28 is provided for detecting at each instant the amount of strip 3 left on reel 4. Device 28 comprises a shaft 29 mounted for rotation through base 6 and fitted with a lever 30 supporting for rotation, on its free end, a feeler roller 31 maintained contacting the periphery of reel 4 by elastic means (not shown) between lever 30 and base 6. On reaching an angular position wherein roller 31 substantially contacts the outer periphery of core 5, shaft 29, by means of a control element not shown and normally consisting of a microswitch, operates a device (not shown) for activating shaft 7 which, when activated, cuts strip 3 by means of blade 11.

A second reel 32 for a second strip 33 identical to strip 3 is set up on base 6, to the side of reel 4, and is supported for rotation on base 6 by means of a saddle defined by two rollers 34, 35 supported for rotation on respective pins 36, 37 fitted to base 6. Roller 35 is a drive roller, and presents two outer flanges 38 (only one shown) for transversely guiding reel 32 as it is rotated (clockwise in FIG. 1) in relation to base 6.

As shown in FIG. 2, roller 35, which rotates anticlockwise in FIG. 1, is driven by a gear 39 coaxial and integral with roller 35 and meshing with a gear 40 fitted to a shaft 41 driven by a motor 42 (FIG. 1). Shaft 41 is supported on base 6 in a horizontally intermediate position in relation to reels 4 and 32, and is rotated clockwise (in FIG. 1) by motor 42 at a variable angular speed as described below.

On the opposite side of shaft 41 to roller 35, base 6 supports a switching device 43 comprising a further shaft 44 parallel to shaft 7 and, like shaft 7, rotated about its axis by a known actuating device (not shown). Shaft 44 is fitted with an arm 46, the free end of which is fitted with a rotary pin 47 extending through a curved slot 48 in base 6 and fitted with a roller 49. The length of arm 46 is such that, for each oscillation of shaft 44 about its axis, pin 47 is moved along slot 48 between a lowered idle position and a raised operating position (shown by the dotted line in FIG. 2) wherein roller 49 is positioned beneath roller 9 with its periphery pressed onto that of roller 9. Pin 47 is fitted with a gear 50 connected to gear 40 of drive shaft 41 via the interposition of a gear 51 mounted idly on shaft 44, for rotating roller 49 clockwise (in FIG. 1) about its axis.

The surface of arm 46 facing reel 4 is fitted with a plate 52 extending along arm 46 towards roller 49, and comprising, on its free end, a curved portion 53 outwardly concave in relation to arm 46 and fork-shaped to permit the passage of a peripheral portion of roller 49. The length of plate 52 is such that, when arm 46 is set to said operating position, the free end of curved portion 53 is aligned with the input of guide 12.

Adjacent to the end of plate 52 in the lowered position, base 6 is fitted with a sensor 54 for the purpose described below; and a further sensor 55 is provided over portion 15 of guide 12.

As shown more clearly in FIGS. 5 to 9, guide 12 comprises a flat plate 56 slightly narrower than strips 3 and 33, and strengthened at the bottom by a longitudinal rib 57. Both plate 56 and rib 57 are divided into three portions 56*a*, 56*b*, 56*c* and 57*a*, 57*b*, 57*c* extending along portions 15, 16 and 18 of guide 12.

At the output end of portion 15 and the input end of portion 16, guide 12 presents two upper bridge elements 58 similar to blades 14 and 21 and connected to each other by an upper cross member 58*a* for connecting guide 12 to base 6. Each element 58 comprises two lateral, substantially L-shaped bodies 59, each in turn comprising an elongated plate 60 parallel to plate 56 and facing a respective lateral portion of plate 56 to define, with plate 56, a gap 61 for the passage of strips 3 and 33. Each element 58 also comprises an appendix 62 extending from an outer edge of respective plate 60 towards plate 56 and separated from appendix 62 of the other plate 60 by a distance approximately equal to but no less than the width of strips 3 and 33.

Close to the opposite longitudinal ends of movable device 17, portion 57*c* of rib 57 supports two cross members 63 and 64 (FIGS. 3 to 9) fitted at the opposite ends with respective pins 65 and 66 parallel to the longitudinal axis of guide 12 and mounted for rotation through respective holes formed in respective brackets 67 and 68. More specifically, each pin 65 is coaxial with respective pin 66 and upstream from it in the traveling direction of strips 3 and 33 along guide 12, so as to define, with pin 66, a respective hinge 69 with its longitudinal axis 70 parallel to guide 12; and each bracket 67 is made integral with respective bracket 68 by means of a substantially C-section rod 71 parallel to axis 70. As shown in FIGS. 6 to 9, each rod 71 comprises a core 72 extending facing a respective lateral edge of portion 56c of plate 56; and two wings 73, 74, the top one 73 of which extends inside gap 61 and is positionable over a respective lateral portion of strip 3, and the bottom one 74 of which is fitted integral with respective brackets 67 and 68.

At the end adjacent to hinge 20, each rod 71 is fitted with a transverse appendix 75 extending downwards from rod 71 and engaging a respective actuating block 76 which, as shown in FIGS. 6 to 9, is supported on cross member 64 and comprises an outer wall 77 and an inner wall 78 parallel to each other and to core 72 of respective rod 71, and defining a chamber 79 engaged by respective appendix 75. Wall 77 is fitted through with a screw 80 supporting a helical spring 81 which acts on respective appendix 75 to maintain respective rod 71 in the idle position shown in FIGS. 6 and 9, wherein rod 71 is rotated about axis 70 so that wing 73 is positioned outwards in relation to strip 3 supported, in use, on portion 56*c* of plate 56. Wall 78 is fitted through with the movable output rod 82 of a linear actuator 83 which acts on appendix 75 coaxially with and in opposition to spring 81, to move respective rod 71 into the operating position shown in FIGS. 7 and 8, wherein respective core 72 is positioned vertically, and respective wing 73 extends, in use, over a respective lateral portion of strip 3.

Figure 5:
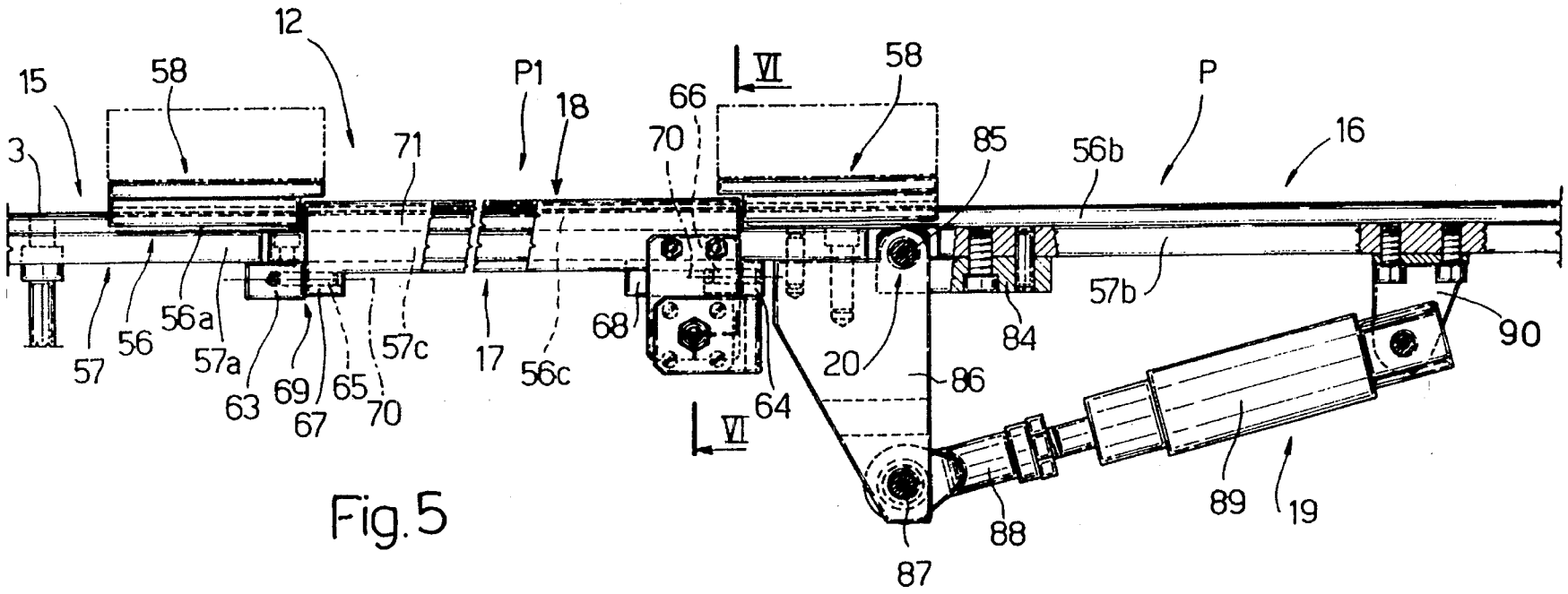
FIG. 5 shows a larger-scale view of a detail in FIG. 3.
Figure 6:
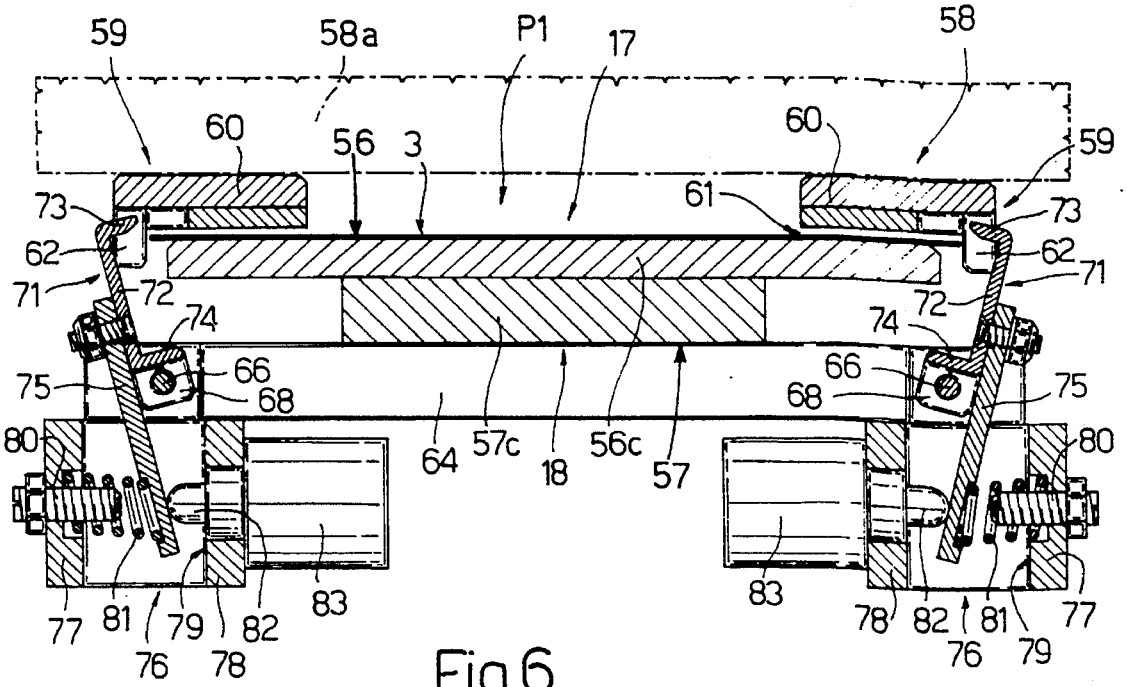
FIG. 6 shows a section along line VI—VI in FIG. 5.
Figure 7:
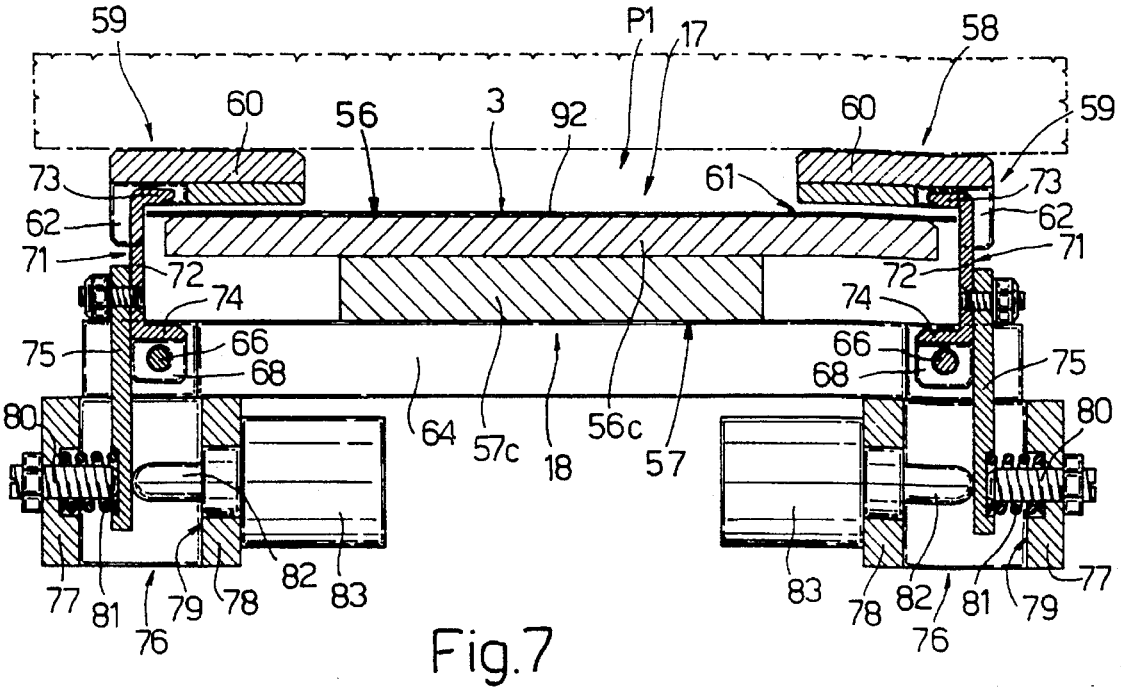
FIGS. 7 to 9 show the FIG. 6 detail in different operating positions.

As shown in FIG. 5, hinge 20 is defined by a bracket 84 connected integral with portion 57*b* of rib 57 and fitted with a pin 85 perpendicular to guide 12; and by two plates 86 (only one shown in FIG. 5), each integral with portion 57*c* of rib 57 and having a through hole engaged in rotary manner by pin 85. Plates 86 extend downwards from portion 57*c* of rib 57, and are connected to each other, close to the bottom ends, by a further pin 87 to which is connected the end of the output rod 88 of actuating device 19. Device 19 consists of a jack, the body 89 of which is hinged to a bracket 90 integral with portion 57*b* of rib 57.

In actual use, during normal operation, strip 3 is drawn along by traction unit 13 powered by a main motor (not shown) of packing machine 2, and is fed about roller 9, into guide 12, and along portions 15 and 16 of guide 12 via device 17 wherein portion 56*c* of plate 56 is aligned with portions 56*a* and 56*b* of portions 15 and 16.

During normal operation, a standby reel 32 is loaded in known manner onto rollers 34 and 35, and motor 42, formerly off, is started, e.g. by means of a manual control, to rotate roller 35 and unwind part of strip 33, a leading portion 91 of which is fed downwards onto plate 52 and past the end of curved portion 53 where it is detected by sensor 54 which stops motor 42, leaving strip 33 in the above standby position.

As strip 3 is unwound off reel 4, feeler roller 31 gradually moves closer to core 5 until, when only a few turns of strip 3 are left on core 5, shaft 29 operates the actuator (not shown) of blade 11 to cut the by now runout strip 3.

When strip 3 is cut, the trailing portion 92 of strip 3 (FIG. 4) travels past sensor 55 which, upon the passage of the rear edge of portion 92, starts motor 42 and operates the actuator (not shown) of shaft 44.

When operated, the actuator (not shown) of shaft 44 raises arm 46 to align curved portion 53 of plate 52 with the input end of guide 12, and bring roller 49 into contact with the periphery of roller 9 and so grip portion 91 of strip 33 between rollers 49 and 9 and position it in front of the input of guide 12.

At the same time, motor 42 rotates reel 32 by means of roller 35, and pushes strip 33 forward by rotating roller 49 by means of gear train 40, 51 and 50, so that portion 91 of strip 33 is engaged inside guide 12 and begins traveling along portion 15 of guide 12 towards machine 2.

In known manner not shown, the feed motor (not shown) of strip 3 and feed motor 42 of strip 33 present respective encoders (not shown) for emitting signals proportional to the traveling speed, along guide 12, of trailing portion 92 of strip 3 and leading portion 91 of strip 33 respectively. The encoder signals are supplied to a computer (not shown) which, as of the instant in which sensor 55 emits a "start" signal corresponding to passage of the trailing edge of portion 92 of strip 3, measures the distances traveled by strips 3 and 33, and regulates in closed-loop manner the speed of motor 42 so that, whereas trailing portion 92 travels along guide 12 at a substantially constant speed V1, leading portion 91 of strip 33, traveling along guide 12 at a speed V2, reaches and is at least partially superimposed on trailing portion 92 of strip 3 before reaching traction unit 13. For example, speed V2 of strip 33 is maintained greater than speed V1 of strip 3 until the two strips overlap, after which speeds V1 and V2 are maintained equal to each other.

Figure 8:
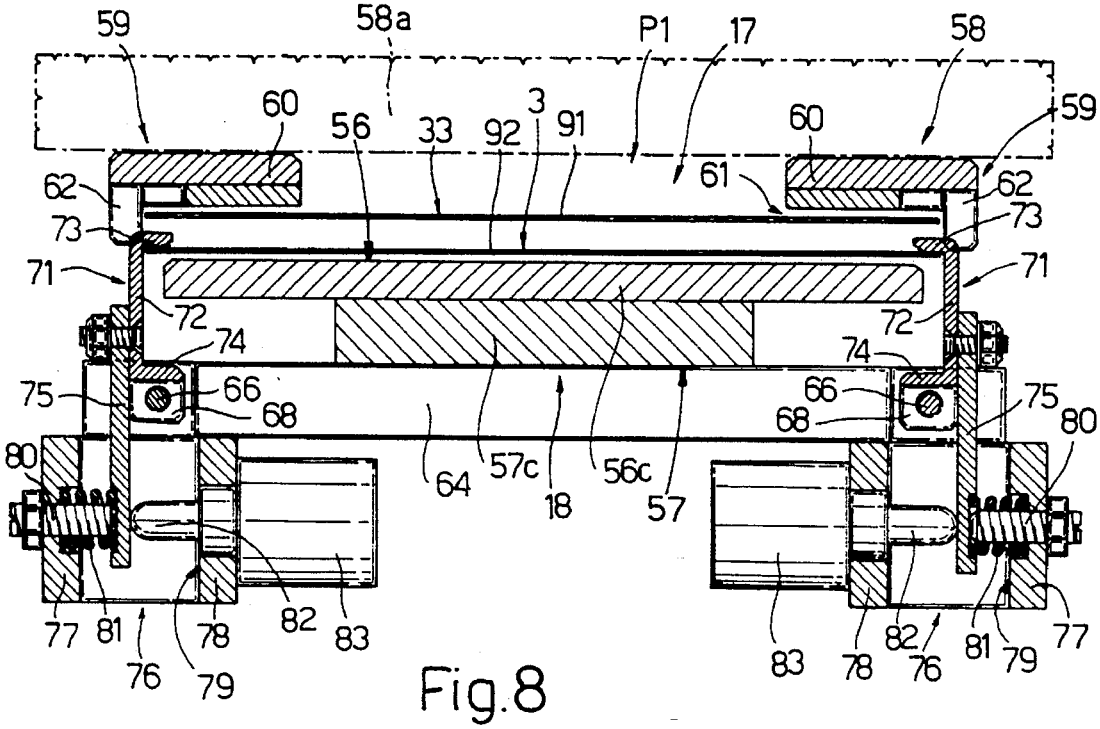
Figure 9:
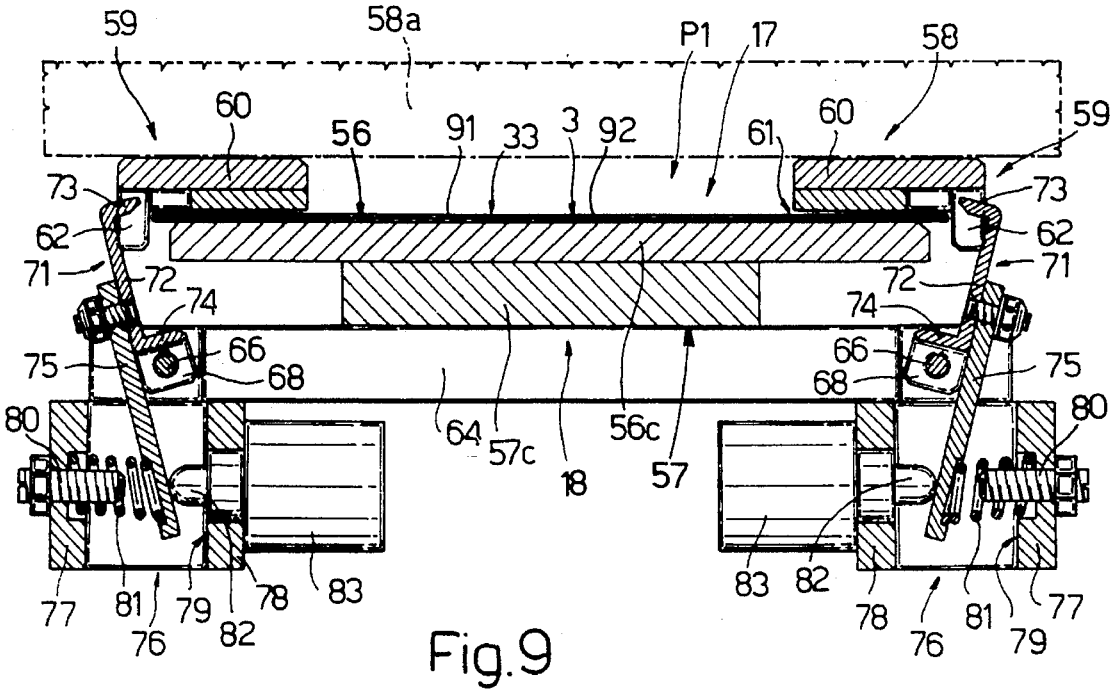

In any case, and as shown in FIG. 8, speeds V1 and V2 are so regulated that leading portion 91 of strip 33 reaches trailing portion 92 of strip 3 as portion 92 engages movable guide device 17 which provides for ensuring portion 91 is superimposed correctly on portion 92.

As shown in FIGS. 6 to 9, during normal operation of device 1, device 17 is set to the raised guide position (FIG. 6) wherein portion 56*c* of plate 56 is aligned with portions 56*a* and 56*b*, strip 3 is fed along portion P1 of path P inside gap 61, and rods 71 are maintained by springs 81 in the inclined idle position (FIG. 6) with respective wings 73 outside gap 61.

Conversely, upon strip 3 being cut by blade 11 and sensor 55 detecting passage of the trailing edge of portion 92 of strip 3, a signal emitted by sensor 55 operates actuators 83 so that rods 71 (FIG. 7) are rotated about respective axes 70 into the vertical position wherein respective wings 73 are positioned over the lateral edges of trailing portion 92 of strip 3, to retain portion 92 transversely and in axially-movable manner on portion 56*c* of plate 56. The signal emitted by sensor 55 also operates actuating device 19 (FIG. 5) to rotate portion 18 of guide 12 downwards about hinge 20, so that the trailing portion 92 of strip 3, traveling at speed V1 and transversely integral with portion 56*c* of plate 56, slopes downwards to permit the leading portion 91 of strip 33, arriving at speed V2 greater than V1, to be superimposed correctly on portion 92 before this leaves portion P1 of path P.

Once the two strips are superimposed, device 17 (FIG. 9) is restored to its original position, and strip 33 proceeds at a speed V2 equal to speed V1, so that its portion 91 remains superimposed on portion 92 until traction unit 13 is reached and replacement of strip 3 completed.

We claim:

1. A method of changing strip material, comprising:

cutting a first strip (3), said first strip (3) being connected to traction means (13) for being drawn and fed at a first given speed (V1) along a given path (P), said cutting of said first strip (3) defining a trailing portion (92) thereof;

upon passage of said trailing portion (92) of said first strip (3) through a given point along said path (P), pushing a second strip (33) along said path (P) at a second given speed (V2);

shifting said trailing portion (92) of said first strip (3) in relation to said path (P);

controlling said second speed (V2) as a function of said first speed (V1) so that a leading portion (91) of said second strip (33) reaches and is superimposed on said trailing portion (92) of said first strip (3); and restoring said trailing portion (92) with said superimposed leading portion (91) to said path (P).

2. The method as claimed in claim 1, wherein said controlling of said second speed (V2), subsequent to said superimposing of said trailing (92) and leading (91) portions, keeps said leading (91) and trailing (92) portions in said superimposed position on being engaged by said traction means (13).

3. The method as claimed in claim 1, and further comprising defining said path (P) by guide means (12), a portion of said guide means being defined by a movable guide device (17), said trailing portion (92) being moved to and from said path (P) by respectively raising and lowering said movable guide device (17) in relation to the path (P) simultaneously with the passage of said trailing portion (92) on the movable guide device (17).

4. The method as claimed in claim 3, and further comprising retaining said trailing portion (92) in a transversely-fixed, axially-movable manner on said movable guide device (17) as said movable guide device (17) is lowered and raised.

5. The method as claimed in claim 3, wherein said second speed (V2) is maintained greater than said first speed (V1) along at least part of said path (P) upstream from said movable guide device (17).

6. The method as claimed in claim 3, wherein said second speed (V2) is maintained greater than said first speed (V1) over a first part of said path (P) upstream from said movable guide device (17), and substantially equal to said first speed (V1) over a second part of said path (P) downstream from said movable guide device (17).

7. The method as claimed in claim 2, and further comprising defining said path (P) by guide means (12), a portion of said guide means being defined by a movable guide device (17), said trailing portion (92) being moved to and from said path (P) by respectively raising and lowering said movable guide device (17) in relation to the path (P) simultaneously with the passage of said trailing portion (92) on the movable guide device (17).

8. The method as claimed in claim 7, and further comprising retaining said trailing portion (92) in a transversely-fixed, axially-movable manner on said movable guide device (17) as said movable guide device (17) is lowered and raised.

9. The method as claimed in claim 7, wherein said second speed (V2) is maintained greater than said first speed (V1) along at least part of said path (P) upstream from said movable guide device.

10. The method as claimed in claim 7, wherein said second speed (V2) is maintained greater than said first speed (V1) over a first part of said path (P) upstream from said movable guide device (17), and substantially equal to said first speed (V1) over a second part of said path (P) downstream from said movable guide device (17).

11. A device for changing strip material comprising two strips (3, 33); the device comprising traction means (13) for drawing a first of said strips (3, 33) along a given path (P) and at a first given speed (V1); guide means (12) defining said path (P); cutting means (11) for cutting the first strip (3); sensor means (55) for detecting passage of the trailing portion (92) of the first strip (3) through a given point along said path (P); and push means (9, 49), activated by said sensor means (55), for feeding the second (33) of said strips (3, 33) along said path (P) at a second given speed (V2); a portion (18) of said guide means (12) being a movable portion forming part of a movable guide device (17) movable to and from a guide position aligned with said path (P) and downstream from said given point in the travelling direction of said strips (3, 33); said second speed (V2) being variable to permit a leading portion (91) of the second strip (33) to be superimposed on the trailing portion (92) of the first strip (3) along the movable guide device (17).

12. The device as claimed in claim 11, wherein said movable guide device (17) comprises retaining means (71 ) for retaining the first strip (3) in a transversely-fixed, axially-movable manner on said movable portion (18) of the guide means (12).

13. The device as claimed in claim 12, and further comprising:

elastic means (81) for maintaining said retaining means (71) in a normal idle position clear of said first strip (3); and actuating means (76) associated with said retaining means (71) for selectively moving them, in opposition to said elastic means (81), into a position transversely retaining the first strip (3) on the movable guide device (17).

14. The device as claimed in claim 11, wherein, in addition to said movable portion (18), said guide means (12) also comprise two fixed portions (15, 16), a first (15) upstream and second (16) downstream from the movable portion (18) in the traveling direction of the first strip (3); actuating means (19) being provided for moving the movable portion (18) to and from a guide position wherein said movable portion is aligned with said two fixed portions (15, 16).

15. The device as claimed in claim 14, wherein said movable portion (18) is hinged (20) to the input end of said second fixed portion (16) of the guide means (12).

* * * * *